US006790088B2

(12) United States Patent
Ono et al.

(10) Patent No.: US 6,790,088 B2
(45) Date of Patent: Sep. 14, 2004

(54) ELECTRIC CONNECTOR PROVIDED WITH A SHIELD PLATE EQUIPPED WITH THRUST SHOULDERS

(75) Inventors: Koji Ono, Tokyo (JP); Kiyoshi Ooaku, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/426,639

(22) Filed: May 1, 2003

(65) Prior Publication Data

US 2003/0211781 A1 Nov. 13, 2003

(30) Foreign Application Priority Data

May 9, 2002 (JP) ..... 2002-133972

(51) Int. Cl.[7] ..... H01R 13/648
(52) U.S. Cl. ..... 439/607; 439/79
(58) Field of Search ..... 439/608, 79, 607, 439/108, 701

(56) References Cited

U.S. PATENT DOCUMENTS 5,336,098 A * 8/1994 Zell et al. ..... 439/108
5,672,064 A * 9/1997 Provencher et al. ..... 439/79
6,299,484 B2 * 10/2001 Van Woensel ..... 439/608
6,322,393 B1 * 11/2001 Doutrich et al. ..... 439/607
6,520,803 B1 * 2/2003 Dunn ..... 439/608

* cited by examiner

*Primary Examiner*—Tho D. Ta
(74) *Attorney, Agent, or Firm*—Wenderoth, Lind & Ponack, L.L.P.

(57) ABSTRACT

A shielded electrical connector includes a connector body having contact pieces embedded therein and an "L"-shaped shield plate applied to the connector body with its horizontal and vertical sections lying on the top surface and rear side of the connector body, the shield plate having press-fit portions integrally connected to the lower end of the vertical section. The shield plate has thrust shoulders formed at its horizontal-to-vertical transition for use in pushing the press-fit portions. The electrical connector can be fixed to a printed circuit board by applying a push to the thrust shoulders of the shield plate, thereby pushing the press-fit portions of the shield plate right in the through holes in exact linear-alignment with the through holes. Thus, a strong thrust can be transmitted to each press-fit portion without causing it to be deformed or bent.

11 Claims, 6 Drawing Sheets

ELECTRIC CONNECTOR PROVIDED WITH A SHIELD PLATE EQUIPPED WITH THRUST SHOULDERS

BACKGROUND OF THE INVENTION

1. Field of the Invention

The present invention relates to a hard-metric (abbreviated as HM) connector of the type used in exchangers, servers or computers. It uses a press-fit type of shield plate to facilitate the mounting of the shielded connector onto a printed circuit board.

2. Related Art

Referring to FIGS. 5(A), (B) and (C) and FIG. 6, a conventional electrical connector 10 has a press-fit type of "L"-shaped shield plate 13 tentatively fastened to its body 12 by making the engagement extensions of a flat top 13*a* of the shield 13 to be engaged on a front side of the connector body 12. The shield plate 13 has a vertical section 13*b* extending downward via bent round portion 13*c*. The rear part of the connector body 12 has its bottom raised to a level higher than the bottom of the front part, thus leaving a space to accommodate a printed circuit board 11. As seen from FIGS. 5(C) and 6, the rear part of the connector body has the male contact portions 3*b* of the contact pieces 3 projecting downward from the raised bottom, and press-fit portions 13*d* of the vertical section 13*b* of the shield plate 13 extend parallel to the male contact portions 3*b* of contact pieces 3 so that their tapered ends may be coplanar with the tapering ends of the male contact portions 3*b*. The connector body 12 has female receptacles arranged in a lattice form on its front side, in which the female contact portions of the contact pieces 3 are inserted.

When the electrical connector 10 is fixed to the printed circuit board 11, an "L"-shaped pressing tool having a round comer approximately corresponding to the bent round portion 13*c* of the shield plate 13 is applied to the shielded connector body, and then, a strong thrust is applied to the flat top 13*a* to push the male contact portions 3*b* and the press-fit portions 13*d* into the though-holes of the printed circuit board 11.

Application of a several Newton-strong push to each male contact portion and press-fit portion is apt to bend some or all press-fit portions. Also disadvantageously, before applying a thrust to the connector the "L"-shaped shield plate needs to be tentatively fastened to the connector body 12 with a piece of double-sided adhesive tape. This is an elaborate, time consuming process.

One object of the present invention is to provide a shielded electrical connector which is guaranteed to be free of such defects as described above.

SUMMARY OF THE INVENTION

To attain this object an electrical connector comprising a connector body having contact pieces embedded therein and an "L"-shaped shield plate applied to the connector body with its horizontal and vertical sections lying on the top surface and rear side of the connector body respectively, the shield plate having press-fit portions formed at the lower end of the vertical section, is improved according to the present invention in that the shield plate has a plurality of thrust shoulders formed at its horizontal-to-vertical transition to push the press-fit portions.

The electrical connector can be fixed to a printed circuit board by applying a push to the thrust shoulders of the shield plate, thereby pushing the press-fit portions of the shield plate right in the through holes in exact linear-alignment with the through holes. Thus, the strong thrust can be transmitted to each press-fit portion without any possibility of causing it to be deformed or bent.

The shield plate may have engagement extensions formed ahead of its horizontal section, and engagement projections formed in its vertical section; and the connector body may have catch means formed on its front and rear sides respectively, whereby the shield plate can be attached to the connector body.

This arrangement facilitates the tentative fastening of the shield plate to the connector body without the necessity of using any adhesive agent and/or doubled-sided adhesive tape.

Other objects and advantages of the present invention will be understood from the following description of a shielded electrical connector according to one preferred embodiment of the present invention, which is shown in the accompanying drawings.

DETAILED DESCRIPTION OF PREFERRED EMBODIMENT

Figure 1A:
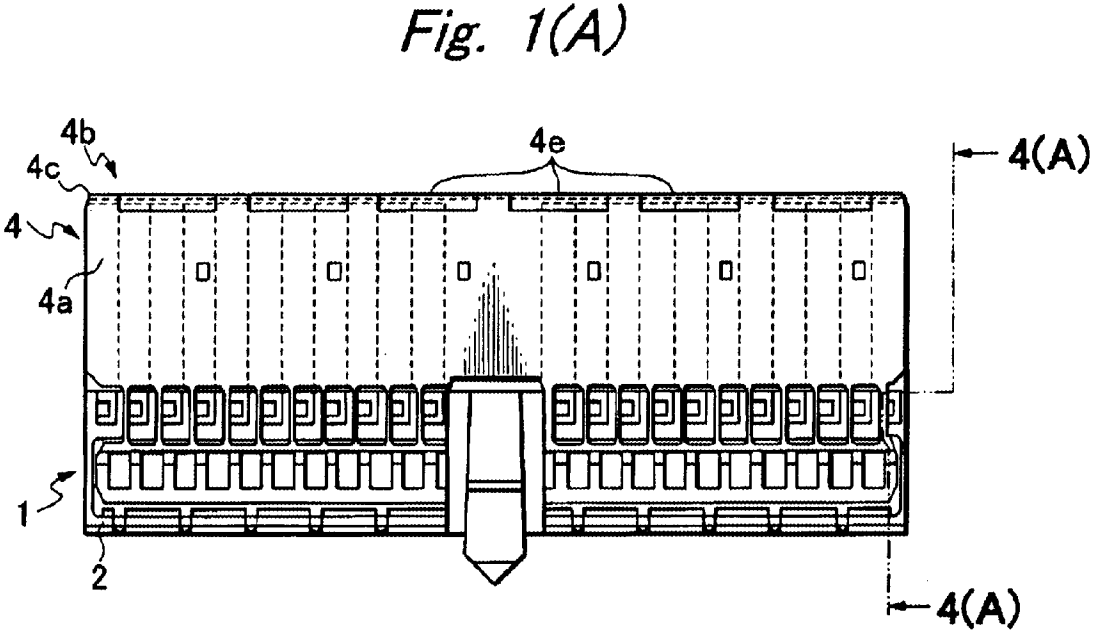
FIGS. 1(A), 1(B) and 1(C) are plan, front and side views of a shielded electrical connector according to the present invention.
Figure 1B:
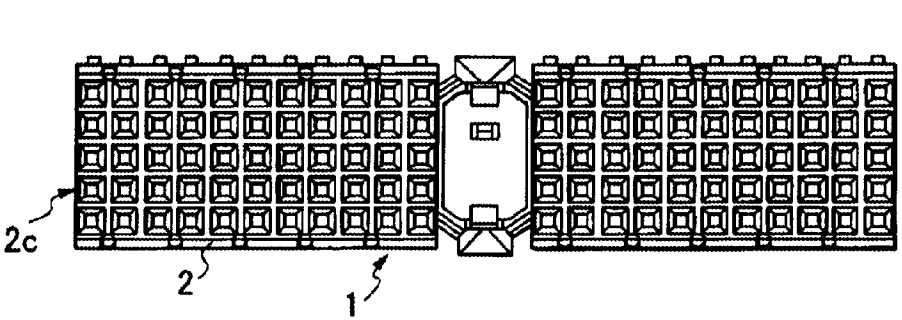
Figure 1C:
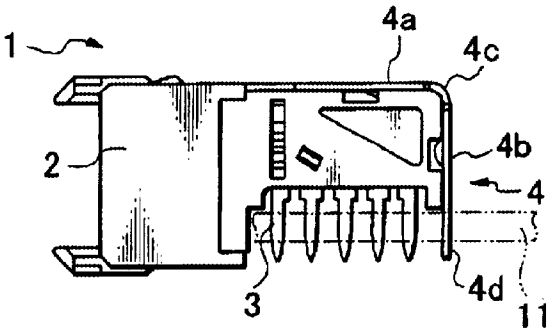

Referring to FIGS. 1(A)–(C), an HM connector 1 comprises a connector body 2 having contact pieces 3 insert-molded therein and an "L"-shaped shield plate 4 applied to the connector body 2 with its horizontal and vertical sections 4*a* and 4*b* lying on the top surface 2*a* and rear side 2*b* of the connector body 2. The shield plate 4 has press-fit portions 4*d* integrally connected to the lower end of the vertical section 4*b* of the shield plate 4.

Figure 4A:
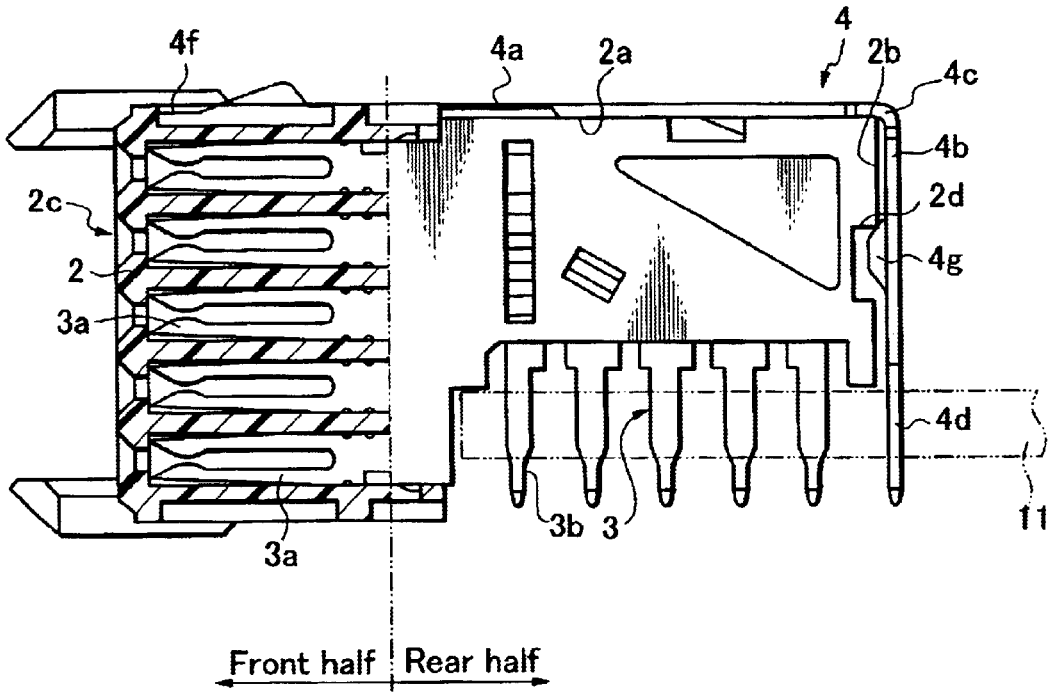
FIG. 4(A) is a side view of the electrical connector, partly in section taken along the line "4(A)"–"4(A)" in FIG. 1(A)

Referring to FIG. 4(A), the connector body 2 comprises front and rear halves integrally connected by insert molding contact pieces 3. The front half has a plurality of female receptacles 2*c* made in a lattice form, and the female contact portions 3*a* are inserted in the female receptacles 2*c*. The rear half of the contact body 2 has the intermediate lengths of the contact pieces 3 embedded therein. The vertical extensions of the contact pieces 3 partly appear from the bottom of the rear half of the conductor body 2 to provide male contact portions 3*b*. As shown in FIG. 4(A), the male contact portions 3*b* are pushed in selected through holes made in the printed circuit board 11.

Figure 2:
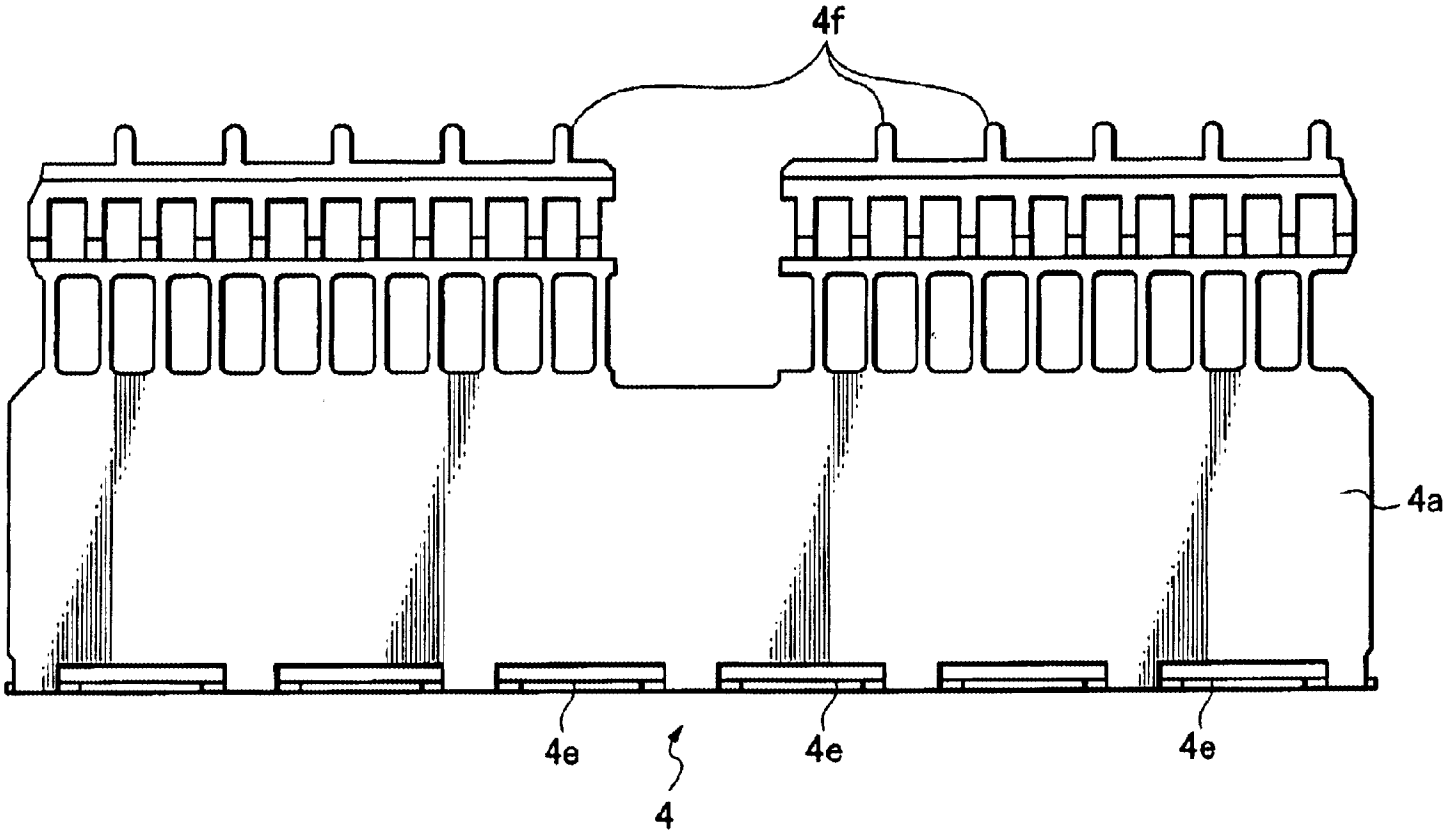
FIG. 2 is a plan view of a shield plate prior to bending into its final shape.
Figure 3A:
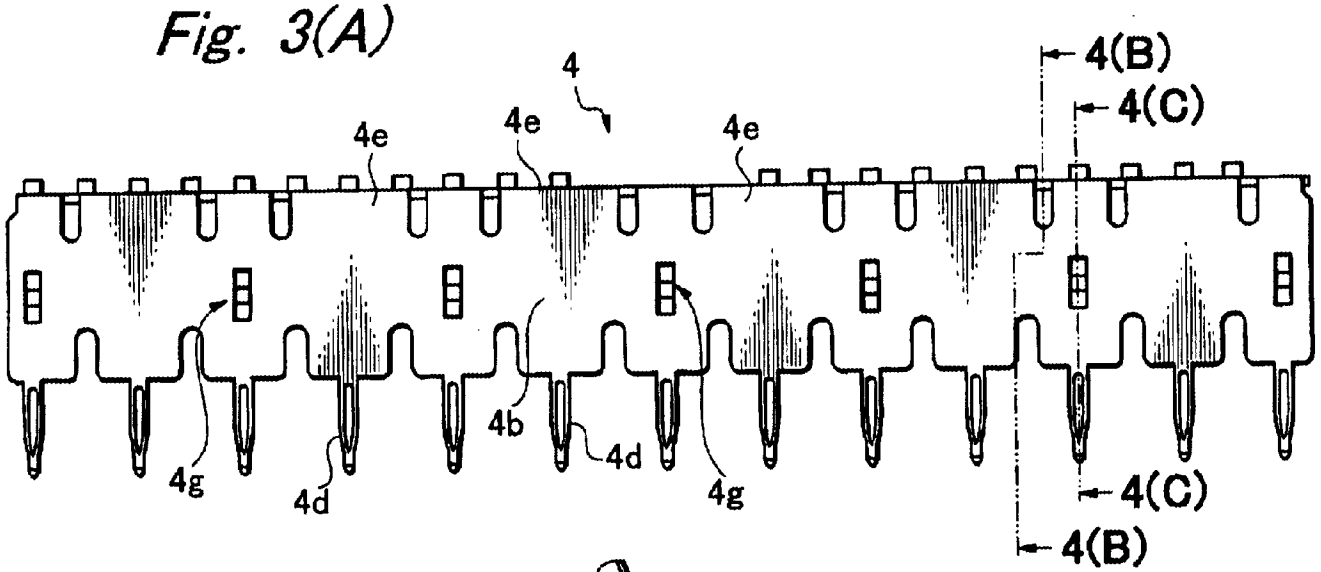
FIGS. 3(A) and 3(B) are rear and side views of the shield plate.
Figure 3B:
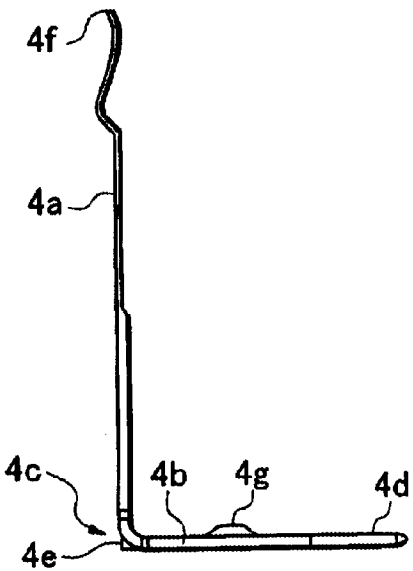
Figure 4B:
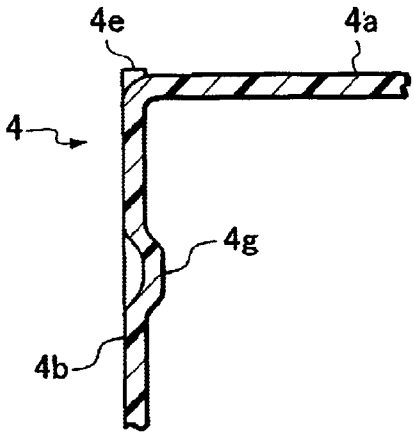
FIGS. 4(B) and 4(C) are sectional views of the fragments of the shield plate including a horizontal-to-vertical transition of the connector, taken along the line "4(C)"–"4(C)" in FIG. 3(A), and the line "4(B)"–"4(B)" in FIG. 3(A) respectively.
Figure 4C:
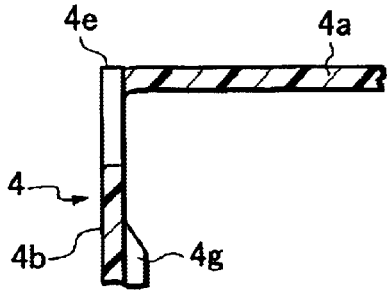
Figure 4D:
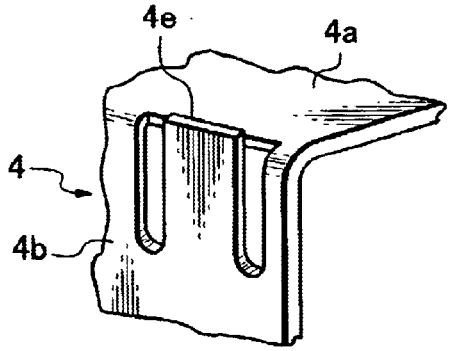
FIG. 4(D) is an enlarged perspective view showing a thrust shoulder of the shield plate.
Figure 5A:
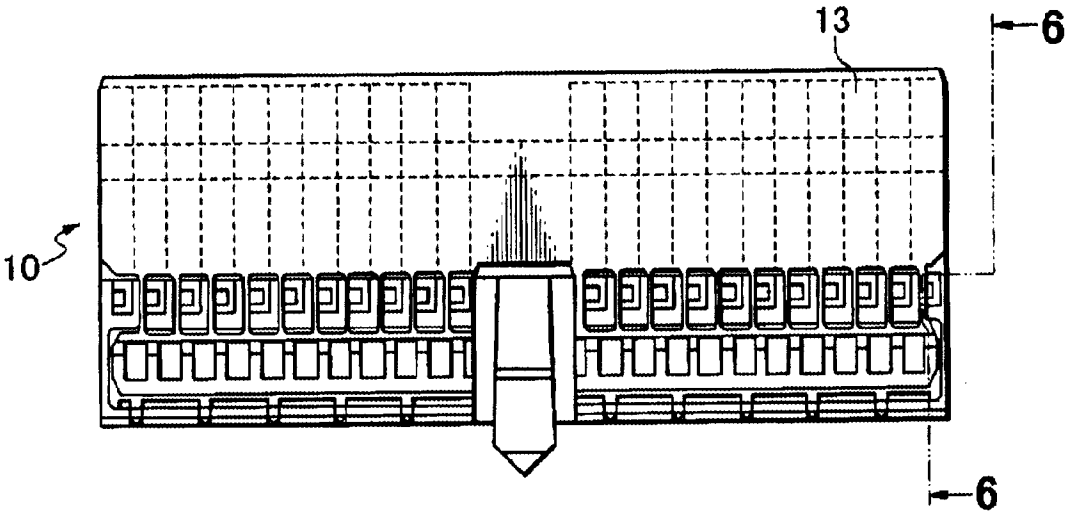
Fig. 5(A) PRIOR ART
FIGS. 5(A), 5(B) and 5(C) are plan, front and side views of a conventional shielded electrical connector, respectively.
Figure 5B:
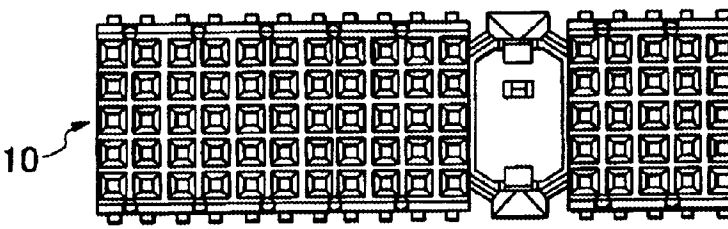
Fig. 5(B) PRIOR ART
Figure 5C:
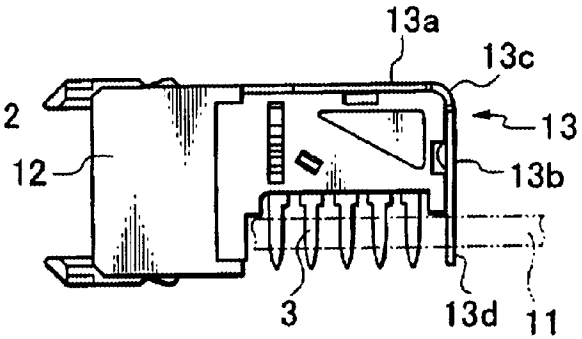
Fig. 5(C) PRIOR ART
Figure 6:
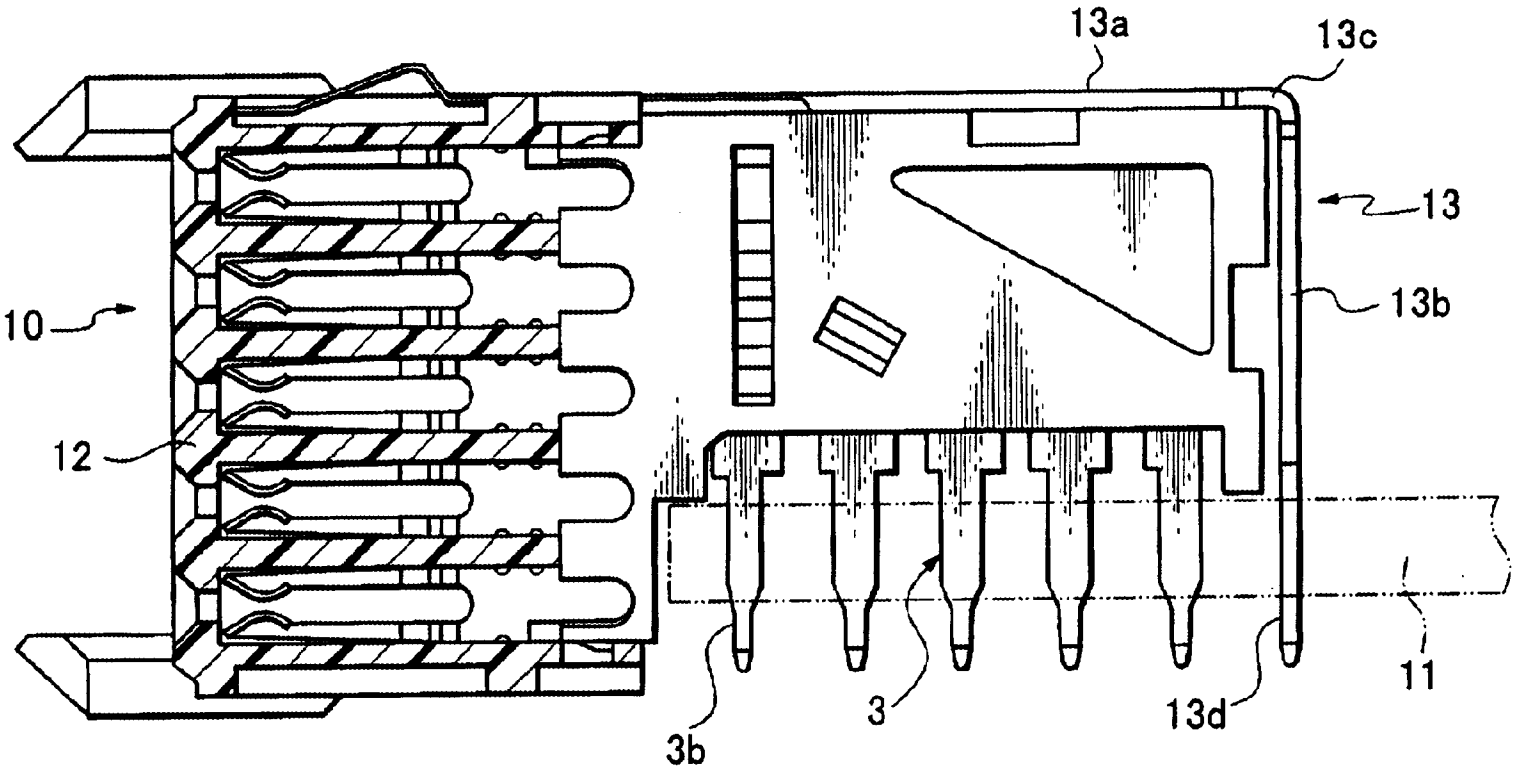
Fig. 6 PRIOR ART
FIG. 6 is a side view of the conventional electrical connector, partly in section, taken along the line "6"–"6" in FIG. 5(A).

As shown in FIG. 2, the shield plate 4 has a plurality of thrust shoulders 4*e* formed at its horizontal-to-vertical transition 4*c* for use in pushing the press-fit portions 4*d* in the through holes of the printed circuit board 11. Such thrust shoulders 4*e* can be formed by making flattened "U"-shaped cuts in a selected linear stripe portion extending from side to side, which linear stripe portion is to be bent at right angles to form a horizontal-to-vertical transition on its rear side when bending the shield plate into its final shape. That is, as shown best in FIGS. 4(B)–4(D), each thrust shoulder 4*e* is constituted by a cut-out from the vertical section 4*b* and is integral and coplanar with the vertical section 4*b*. A top end of each thrust shoulder 4*e* is separated from the horizontal section so as to serve as a pushing location at which a pushing force can be applied in a direction along the vertical section for pushing the press-fit portions 4*d*.

Referring to FIGS. 2 to 4(D) , the shield plate 4 has engagement extensions 4*f* formed ahead of the top flat section (horizontal section) 4*a* on its front side (FIG. 2), and engagement projections 4*g* formed on the vertical section 4*b*. The shield plate 4 can be fastened to the connector body 2 by allowing the engagement extensions and portions 4*f* and 4*g* to be caught by catch portions or recesses 2*d*. Thus, a shielded electrical connector is provided.

The shielded electrical connector thus provided can be fastened to a printed circuit board 11 simply by applying a thrust to the thrust shoulders 4*e* of the "L"-shaped shield 4 to push the male contact portions 3*b* and the press-fit portions 4*d* in the through holes of the printed circuit board 11. The thrust can be transmitted right from the thrust shoulders 4*e* to the press-fit portions 4*d* of the vertical section 4*b* of the "L"-shaped shield 4 so that the press-fit portions 4*d* may be pushed in selected through holes in the printed circuit board 11 without being deformed or bent.

What is claimed is:

1. An electrical connector comprising:

a connector body including a top surface and a rear side, said connector body having contact pieces embedded therein;

an L-shaped shield plate having horizontal and vertical sections for shielding said top surface and said rear side, respectively, of said connector body;

wherein an upper end portion of said vertical section of said L-shaped shield plate is integrally connected to said horizontal section of said L-shaped shield plate to form a horizontal-to-vertical transition;

wherein press-fit portions are formed at a lower end portion of said vertical section of said L-shaped shield plate for insertion into holes of a printed circuit board; and wherein said L-shaped shield plate has a plurality of thrust shoulders formed at said horizontal-to-vertical transition, said thrust shoulders extending integrally from said vertical section and respectively having top ends that are separated from said horizontal section so as to serve as pushing locations at which a push force can be applied in a direction along said vertical section for pushing said press-fit portions.

2. An electrical connector according to claim 1, wherein said horizontal and vertical sections are substantially perpendicular to each other.

3. An electrical connector according to claim 1, wherein said thrust shoulders are coplanar with said vertical section and substantially perpendicular to said horizontal section.

4. An electrical connector according to claim 1, wherein said vertical section of said shield plate is provided with engagement projections, and said connector body has catch recesses formed at a rear part thereof for engaging said engagement projections.

5. An electrical connector according to claim 1, wherein said shield plate has engagement extensions formed at a front part of said horizontal section, and said connector body has catch portions formed at a front part thereof for engaging said engagement extensions.

6. An electrical connector according to claim 5, wherein said vertical section of said shield plate is provided with engagement projections, and said connector body has catch recesses formed at a rear part thereof for engaging said engagement projections.

7. An electrical connector comprising:

a connector body including a top surface and a rear side, said connector body having contact pieces embedded therein;

an L-shaped shield plate having horizontal and vertical sections for shielding said top surface and said rear side, respectively, of said connector body;

wherein an upper end portion of said vertical section of said L-shaped shield plate is integrally connected to said horizontal section of said L-shaped shield plate to form a horizontal-to-vertical transition;

wherein press-fit portions are formed at a lower end portion of said vertical section of said L-shaped shield plate for insertion into holes of a printed circuit board; and wherein said L-shaped shield plate has a plurality of thrust shoulders formed at said horizontal-to-vertical transition, said thrust shoulders constituting cut-outs from said vertical section that extend integrally from and coplanar with said vertical section so as to serve as pushing locations at which a push force can be applied in a direction along said vertical section for pushing said press-fit portions.

8. An electrical connector according to claim 7, wherein said horizontal and vertical sections are substantially perpendicular to each other.

9. An electrical connector according to claim 7, wherein said vertical section of said shield plate is provided with engagement projections, and said connector body has catch recesses formed at a rear part thereof for engaging said engagement projections.

10. An electrical connector according to claim 7, wherein said shield plate has engagement extensions formed at a front part of said horizontal section, and said connector body has catch portions formed at a front part thereof for engaging said engagement extensions.

11. An electrical connector according to claim 10, wherein said vertical section of said shield plate is provided with engagement projections, and said connector body has catch recesses formed at a rear part thereof for engaging said engagement projections.

* * * * *